US009539803B2

(12) United States Patent
Michel et al.

(10) Patent No.: US 9,539,803 B2
(45) Date of Patent: Jan. 10, 2017

(54) METHOD FOR DETECTING FAILED PRINTING NOZZLES IN INKJET PRINTING SYSTEMS AND INKJET PRINTING MACHINE

(71) Applicant: HEIDELBERGER DRUCKMASCHINEN AG, Heidelberg (DE)

(72) Inventors: Christoph Michel, Darmstadt (DE); Hans Koehler, Edingen-Neckarhausen (DE); Ralf Tita, Hirschhorn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/137,133

(22) Filed: Apr. 25, 2016

(65) Prior Publication Data

US 2016/0311218 A1 Oct. 27, 2016

(30) Foreign Application Priority Data

Apr. 24, 2015 (DE) ..... 10 2015 207 566

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ... B41J 2/0459; B41J 2/04591; B41J 2/04596; B41J 2/04598; B41J 2/075; B41J 2/08; B41J 2/085; B41J 2/09; B41J 2/095; B41J 2/10; B41J 2/12; B41J 2/125; B41J 2/13; B41J 2002/022; B41J 2/04503; B41J 2/04505; B41J 2/04506; B41J 2/04508; B41J 2/0451; B41J 2/04513;B41J 2/04515; B41J 2/0452; B41J 2/04525; B41J 2/04526; B41J 2/04528; B41J 2/04531; B41J 2/04535; B41J 2/04536; B41J 2/04558; B41J 2/0456; B41J 2/04561; B41J 2/04563; B41J 2/04565; B41J 2/04566; B41J 2/04568; B41J 2/0457; B41J 2/04571; B41J 2/04573
See application file for complete search history.

(56) References Cited

U.S. PATENT DOCUMENTS 6,030,072 A * 2/2000 Silverbrook ..... B41J 2/04508 347/14
8,322,814 B2 12/2012 Hirato et al.
(Continued)

FOREIGN PATENT DOCUMENTS

| | | | |
|---|---|---|---|
| EP | 2626209 | A1 | 8/2013 |
| EP | 2789468 | A1 | 10/2014 |
| JP | 2011209105 | A | 10/2011 |

*Primary Examiner* — Kristal Feggins
(74) *Attorney, Agent, or Firm* — Laurence A. Greenberg; Werner H. Stemer; Ralph E. Locher

(57) ABSTRACT

A method for automated detection of failed printing nozzles in an inkjet printing machine includes the following steps:

carrying out a printing process to produce a first printed image with print image data, scanning and digitizing the first printed image produced in the printing process by using at least one image sensor, digitally offsetting the first printed image in the control unit by at least one printing nozzle in a direction transverse to the printing direction, carrying out a further printing process to produce a second printed image based on the digitally offset first printed image, scanning and digitizing the second printed image by using the at least one image sensor, (Continued)

comparing the first and second scanned printed images in the control unit.

Failed printing nozzles are identified by using the control unit based on the result of the comparison.

9 Claims, 5 Drawing Sheets

(56) References Cited

U.S. PATENT DOCUMENTS

| | | | | |
|---|---|---|---|---|
| 8,531,743 | B2 | 9/2013 | Wu et al. | |
| 9,050,795 | B2 | 6/2015 | Ueshima | |
| 2010/0156982 | A1* | 6/2010 | Sasagawa | B41J 2/0451 347/14 |
| 2010/0253982 | A1 | 10/2010 | Kasai et al. | |
| 2011/0227988 | A1 | 9/2011 | Yamazaki | |
| 2013/0141484 | A1 | 6/2013 | Kasai et al. | |
| 2013/0187970 | A1 | 7/2013 | Inoue | |
| 2013/0187973 | A1* | 7/2013 | De Smet | B41J 2/0451 347/14 |
| 2014/0093139 | A1 | 4/2014 | Yamagishi | |

* cited by examiner

METHOD FOR DETECTING FAILED PRINTING NOZZLES IN INKJET PRINTING SYSTEMS AND INKJET PRINTING MACHINE

CROSS-REFERENCE TO RELATED APPLICATION

This application claims the priority, under 35 U.S.C. §119, of German Patent Application DE 10 2015 207 566.4, filed Apr. 24, 2015; the prior application is herewith incorporated by reference in its entirety.

BACKGROUND OF THE INVENTION

Field of the Invention

The present invention relates to a method for the automated detection of failed printing nozzles in an inkjet printing machine by using a control unit. The present invention also relates to an inkjet printing machine having a control unit for implementing the method.

The technical field of the invention is the field of digital printing.

Inkjet printing machines in general include one or more print heads and every print head includes a plurality of printing nozzles. The inkjet printing machines use the nozzles to print by the ejection of ink. The printing machines have nozzle plates with specific configurations of the individual nozzles, allowing a resolution of up to 1200 dpi. That requires nozzle interspaces of approximately 20 μm. When an individual nozzle fails, there are areas that cannot be imaged by the nozzle that was provided for that purpose in the individual color separation in accordance with BCMY. As a result, colorless areas are created, which may occur as white lines. In a multicolor print, the corresponding color is missing at the point in question and the color values are distorted. Another aspect is that the ejection path of an individual nozzle is not ideal but may deviate from the ideal path to a greater or lesser extent. In addition, the size of the jetted dot is to be taken into consideration. Thus a malfunctioning nozzle has an effect on the print quality of every printed document. The reasons for such a failure of individual nozzles are manifold. The failure may be temporary or permanent.

Various compensatory approaches are known in the art in order to reduce the effect on the printed image in solid areas in particular. In one approach, an attempt is made to cover up the defect by other nozzles of the same color and of the same inkjet unit. That is to say that to compensate for individual failed inkjet printing nozzles, once the individual nozzle has been identified, the adjacent nozzles are controlled in such a way that the dot sizes of those nozzles are increased to such an extent that they also cover the area of the failed nozzle. Thus the adjacent nozzles write the image of the failed nozzle. White lines that occur when individual nozzles do not print may thus be avoided.

Another known approach is to replace the failed printing nozzle by the nozzles of the respective other printing colors in use at the same location. In that process, an attempt is made to get as close as possible to the failed printing color by a systematic and controlled overprinting of the colors that are still available. That does not require a redundancy of printing nozzles or printing heads nor does a failure of adjacent nozzles present a problem. A major disadvantage of that compensatory process is, however, that it can only be used for multicolor printing. Moreover, it requires an increased computing and controlling effort by the control unit of the printing machine to establish the required color combinations. In addition, the print result may well deviate significantly from the target values depending on the color difference of the failed color from the still printable color space of the remaining colors.

Other approaches to compensate for failed printing nozzles envisage the provision of double nozzle units of the same color to be able to compensate the failure of individual nozzles by redundancy. Alternatively, multiple positionable print heads are used to print an image. If printing nozzles fail, the print heads are repositioned to replace the failed nozzle as well as possible. Both approaches de facto require a redundancy of print heads of the same color, involving the aforementioned problems.

A prerequisite for such a compensatory process is, however, the correct detection of a failed printing nozzle, involving not only the detection of the failure itself but also the identification of the actual failed nozzle because most known compensatory processes require the exact knowledge of the non-functioning printing nozzles.

Several approaches to a solution of this detection problem are known in the art:

1. Printing Test Prints:

The test prints are then evaluated by the machine operator, i.e. counts are made. The information on potentially failed nozzles is forwarded to the machine by a manual input. Based on that information, a new printed image is created in such a way as to compensate for the failed nozzles. That process may not be carried out during primary processing time. A defect in a printed image needs to be detected first to subsequently initiate the manual process described above. An inspection is necessary, resulting in a loss of production time. In addition, there is no automatic detection and in some cases waste may be the result. Examples of such sample prints are known from U.S. Patent Application Publication US 2011/227988 A1 and U.S. Pat. No. 8,322,814 B2.

2. Printing and Automatically Evaluating a Specific Test Content:

Option A: the test content is printed as a separate job on the printing machine.

Option B: the test content is printed between the individual copies in a web-fed printing process or on an unused paper margin in a sheet-fed printing process.

That test content provides a comparatively simple automated detection of the failed inkjet nozzles. A disadvantage is that a paper margin or interspace between individual copies is undesirable or cannot be implemented for some types of prints. If the sample print is created as a separate print job, a lot of waste is created. A narrow paper margin only allows test contents of limited size, allowing only part of the nozzles to be inspected. That means that an immediate detection and compensation of failed nozzles is not guaranteed. Waste may be produced or alternatively, the paper format may be used insufficiently.

3. Other Options:

Option A: the entire printed image is scanned in real time by using cameras or sensors. The established data then need to be electronically compared to the original printed image. However, the comparison of the data requires a very high computational effort and real-time comparisons between the data. When variable data are used, that means that for every print, the target printed image needs to be made available again for comparison or adapted in accordance with the variable data. That solution to the problem is very costly since it requires high-performance hardware or creates machine downtime while the data are being processed. The system is prone to errors because it is not immediately clear exactly which nozzle row has failed in order to then make compensations. Electronic measuring would require high-precision equipment and would be very costly.

U.S. Patent Application Publication US 2013/187970 A1 is to be cited as an example of such a process. In that case, the digital target image is compared to the scan of the printed image. Transformations that make the scanned image (resolution transformation, transformation of the scanner characteristics) comparable to the digital target image are described. In addition, the document describes the calculation of a difference that is used for detecting a non-functioning nozzle when deviations exceeding defined thresholds occur. The document also mentions printing a reference mark through the use of which a position detection/identification of the non-functioning printing nozzle may be achieved.

Option B: in this case, the entire printed image is likewise scanned in real time by using cameras or sensors. However, then the data are digitally added up in the printing direction in terms of the gray values/intensities or similar variables and a profile transverse to the printing direction is established. If that profile has pixel-wide "drops," the conclusion is that a malfunction has occurred. A major disadvantage in that context is that an intended drop, for instance when printing a bar code, cannot be differentiated from a nozzle malfunction. Known examples from the prior art include U.S. Pat. No. 8,531,743 B2, which describes a system for detecting failed nozzles wherein an image recorded by an optical sensor is searched for strips of different intensity along the printing direction. In that process, an integrated profile is created, searching for drops that drop below a threshold. The document explains methods that allow the scans/lines recorded by the sensor to be allocated to individual printing process colors in order to detect the respective failed nozzles in the printing color.

Another example is European Patent Application EP 2 626 209 A1, which likewise envisages a detection of strips of different intensity along the printing direction. In that process, changing light, i.e. light of different wavelengths, is used to create a respective image per process color, which is then directly searched for strips in the scanned color separation. In that process, an integrated profile is created, which is searched for drops that drop below a threshold.

SUMMARY OF THE INVENTION

It is accordingly an object of the invention to provide a method for detecting failed printing nozzles in inkjet printing systems and an inkjet printing machine, which overcome the hereinafore-mentioned disadvantages of the heretofore-known methods and machines of this general type in terms of the necessity of a sample print and low performance.

With the foregoing and other objects in view there is provided, in accordance with the invention, a method for the automated detection of failed printing nozzles in an inkjet printing machine using a control unit, which comprises the following steps:

1. Carrying out a printing process to produce a first printed image based on print image data,
2. Scanning and digitizing the first printed image produced in the printing process by using at least one image sensor,
3. Digitally offsetting the first printed image by at least one printing nozzle in a direction transverse to the printing direction in the control unit,
4. Carrying out a further printing process to produce a second printed image on the basis of the digitally offset first printed image,
5. Scanning and digitizing the second printed image by using the at least one image sensor,
6. Comparing the first and second scanned printed images in the control unit, and
7. Identifying failed printing nozzles based on the result of the comparison by using the control unit.

The basis for the method of the invention is the detection of failed printing nozzles by offsetting the printed image. For this purpose, the first printed copy is scanned by a camera and offset in the control unit by at least one printing nozzle in a direction transverse to the printing direction. Whether the offsetting is done to the left or to the right is irrelevant as long as there are enough so far unused nozzles in the offsetting direction for the entire copy to be printed despite the offset. Once the printed image has been offset, the next copy is printed, digitized once again, and compared to the old, non-offset image in the control unit. Failed printing nozzles may be detected because in the second copy, vertical free areas in the printing direction have "wandered" by the offsetting width in the second image. If they were integral parts of the printed image, they would have to appear at the same image location in the offset printed image.

An advantage of this method over the known methods of the prior art is that it does not require any specific sample print for detecting a nozzle failure because the detection is based on the actual printed image.

In contrast to the known methods that implement the detection of a nozzle failure in the printed image, however, no knowledge of a target printed image is required. In contrast to known methods that identify missing nozzles in the printed image without knowing the target printed image, no complex analyses of the printed lines over many prints are required. In accordance with the invention, a genuine difference recognizable to an image sensor between two copies of a printed image is created, the sole cause of which may be a defective printing nozzle. Thus the detection obtains a much higher degree of reliability; in addition, the time required for the inspection is much shorter since the number of required printed copies is lower.

Advantageous and thus preferred further developments of the invention will become apparent from the discussion below and from the description with the associated drawings.

In this context, a preferred further development is that in addition to offsetting the first digital printed image by at least one printing nozzle in a direction transverse to the printing direction, the print head is offset by the same amount in the opposite direction.

Since the control unit needs to deduct the offset of the printed image prior to the comparison between the first and second digitized copy—after all, the image sensor continues to be in the same location—it is expedient to compensate for the merely digital offset of the printed image by mechanically offsetting the print head by the same amount in the opposite direction. Thus for the image sensor, the copy is in the old location whereas the offset of the printed image to adjacent nozzles is maintained. This reduces the computing effort involved in the detection for the control unit. Alternatively, the image sensor may be moved by the same amount and in the same direction as the digital offset of the printed image.

In this context, another preferred further development is that the comparison between the first and second scanned digital printed images is done by calculating the difference.

The easiest and most efficient way to compare the two scanned copies is to calculate the difference. A relevant color value may only be present in locations of a defective printing nozzle.

In this context, a preferred further development is that the result of the detection is output to an operator by the control unit on a display.

Although the detection and compensation will preferably be carried out in an automated process in the framework of a workflow process for the printing process, an optional feedback of the detection result to the human operator on a graphical display is a necessary part of the method of the invention.

In this context, another preferred further development is that the detection result is used as a trigger for the initiation of a compensation mode of the inkjet printing machine for the at least one failed printing nozzle.

As mentioned above, the detection result is used as a trigger for the activation of a compensation mode in the framework of the workflow process.

In this context, a preferred further development is that the image sensor only scans an image section of the respective printed image.

The detection process does not have to be carried out over the entire printed copy. It is sufficient to scan only one strip that includes all active printing nozzles. Even smaller inspection areas are possible although they will necessarily mean a corresponding loss of information.

In this context, another preferred further development is that the scanned image section is added up during the ongoing printing process to create a brightness profile and the difference is calculated between the brightness profiles of the scanned image sections of the respective first and second digital printed images.

Since the image artifacts caused by the failed printing nozzles naturally occur in the shape of stripes in the printing direction, instead of a comparison over the entire scanned copy/inspection area, it may be added up to create a brightness profile and then the comparison may be made between the two brightness profiles. This means a massive reduction of the computational effort for the control unit.

In this context, a preferred further development is that the first digital printed image is offset by at least two printing nozzles in a direction transverse to the printing direction and in increments of at least one printing nozzle.

The offsetting of the digital printed image by the total offset may occur in a number of increments. For this purpose, a total offset by the distance of at least two printing nozzles is required. The result is an "optical flow" in the offsetting direction with the exception of those locations in which there are defective printing nozzles. This approach may for instance be of advantage if the printed copy contains image elements that are similar to the stripe-shaped image artifacts or if larger completely unprinted areas are present in the printing direction.

With the objects of the invention in view, there is concomitantly provided an inkjet printing machine for implementation of the method to attain the proposed object of the invention.

Other features which are considered as characteristic for the invention are set forth in the appended claims.

Although the invention is illustrated and described herein as embodied in a method for detecting failed printing nozzles in inkjet printing systems and an inkjet printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
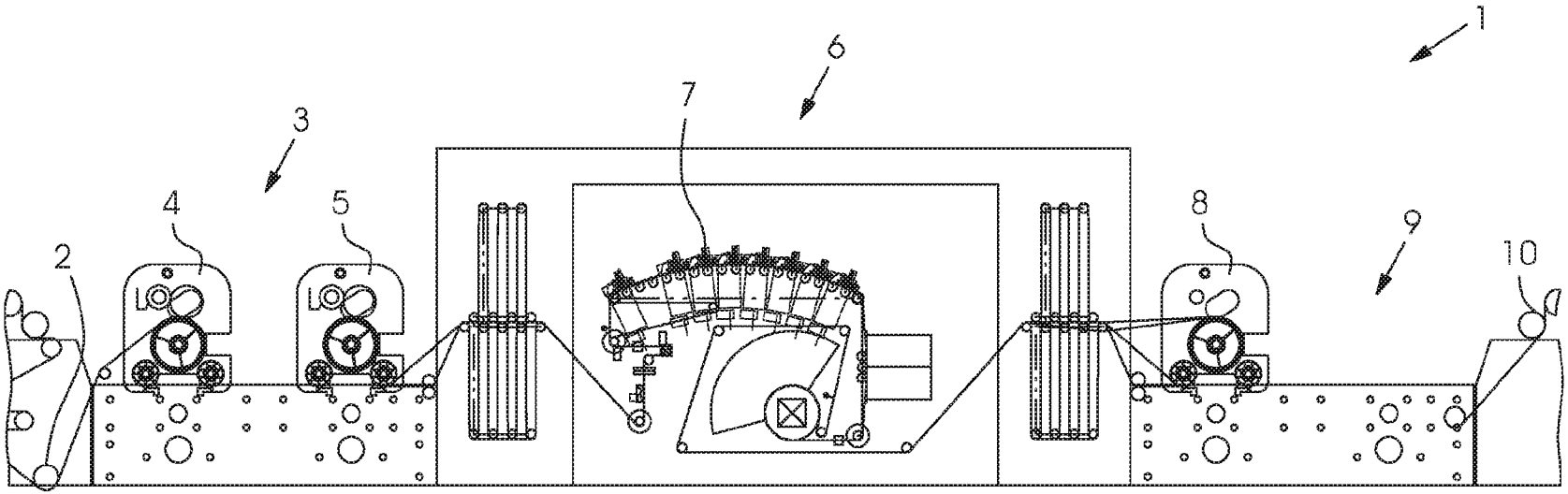
FIG. 1 is a longitudinal-sectional view of an example of a web-fed inkjet printing machine.

Referring now in detail to the figures of the drawings, in which mutually corresponding elements have the same reference numerals, and first, particularly, to FIG. 1 thereof, there is seen a preferred embodiment in which the area of application is an inkjet printing machine 1. An example of the construction of such a machine 1 is shown in FIG. 1. The inkjet printing machine 1 includes an unwinding unit 2 from which a web is unwound and fed to a print preparation stage 3 having a flexographic unit 4 for white/solid areas and a flexographic unit 5 for primer. The web is then fed to a printing unit 6 having print heads 7 with nozzles. The web subsequently travels to a flexographic unit 8 for varnish in a further processing unit 9. Finally, the web is wound up in a wind-up unit 10.

Figure 2:
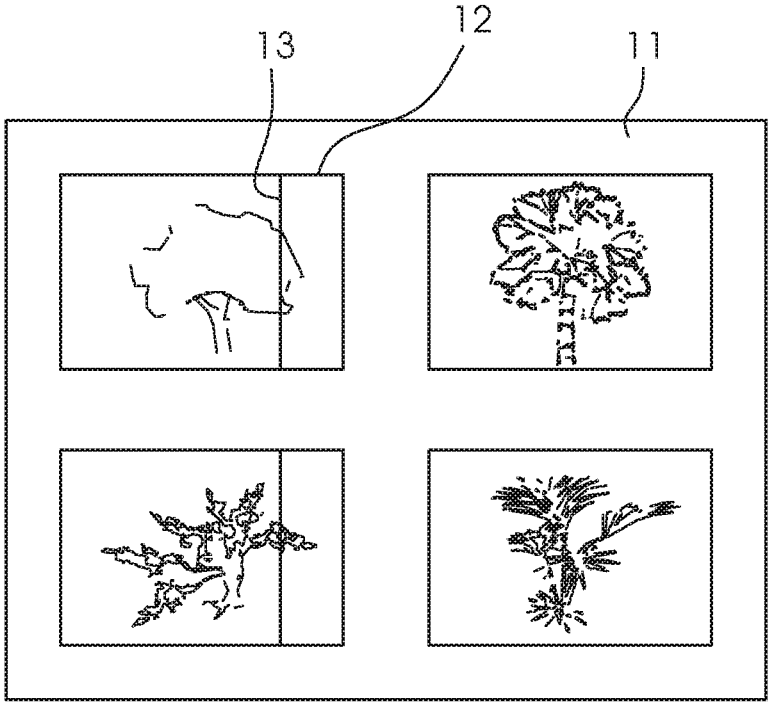
FIG. 2 is a plan view of an example of an image defect created by a printing nozzle failure.

As described in the introduction, individual printing nozzles in the print heads 7 in the printing unit 6 may fail during operation of the printing machine 1. As a consequence, white lines 13 or, in the case of a multicolor print, distorted color values in a copy 12 on a printing substrate 11 will occur. An example of such a white line 13 is shown in FIG. 2.

Figure 3:
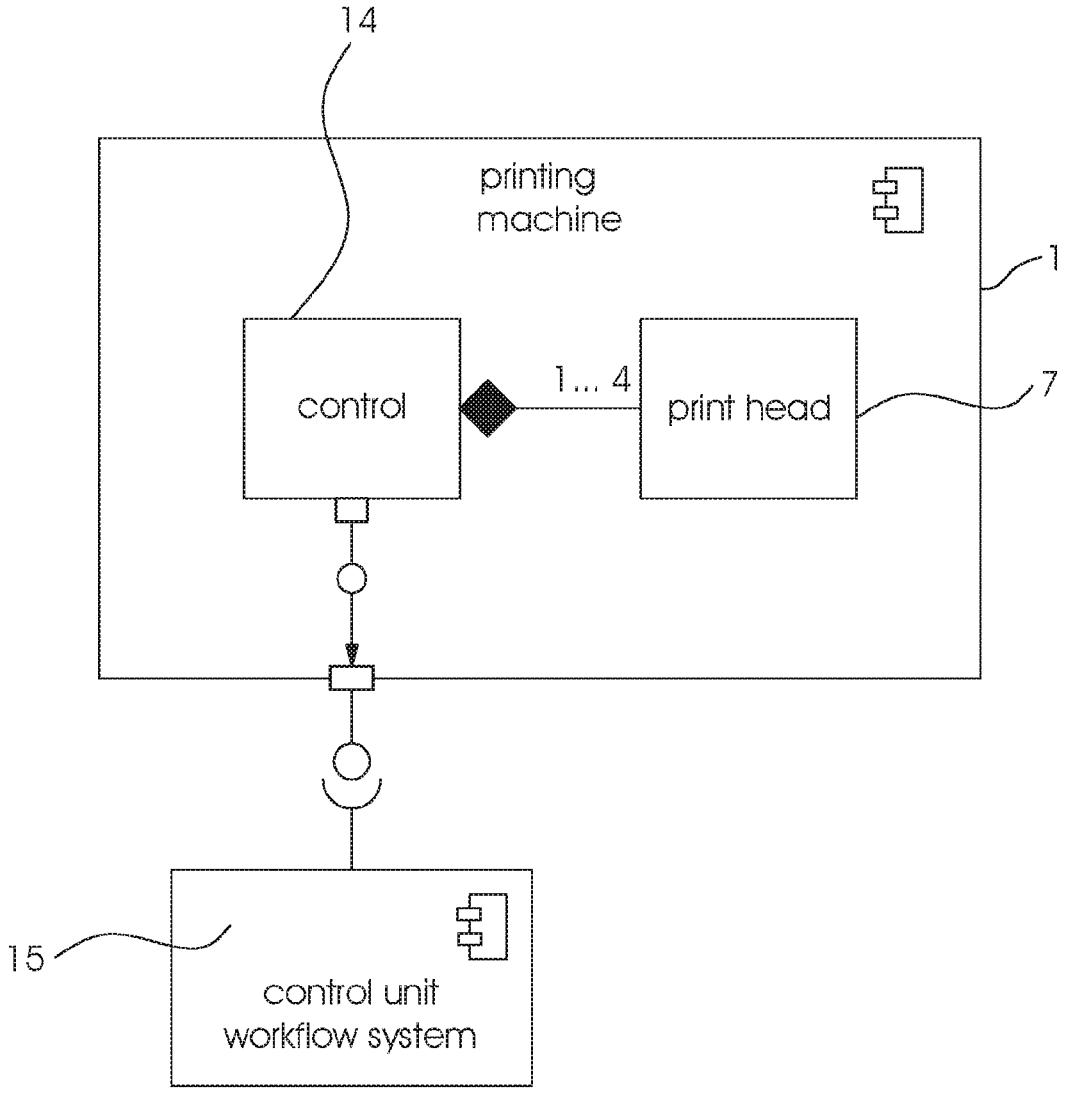
FIG. 3 is a block diagram illustrating the construction of the printing machine system being used.

Since a manual implementation of the described method by an operator would be inefficient, the method is carried out in an automated way by a control unit 15 of the inkjet printing machine 1. FIG. 3 illustrates an example of the construction of such a system. The automated method is integrated in the workflow of the printing machine 1. The configuration of the control unit 15 in terms of individual method steps may be manually corrected by the operator if necessary. The control unit 15 is part of a printing machine control 14.

Figure 4:
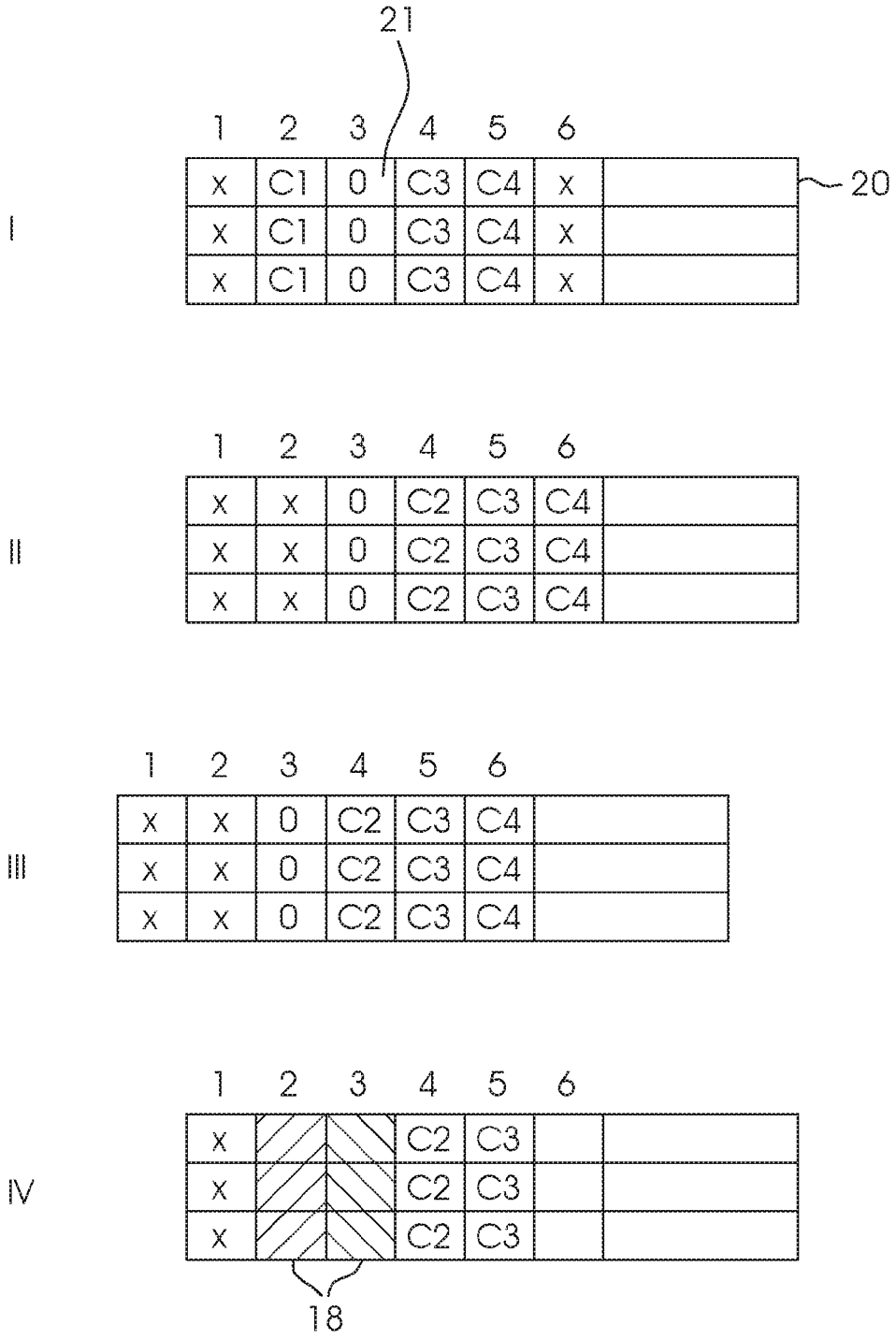
FIG. 4 is a diagrammatic representation of a detection process.

The functional principle of the detection method is shown in detail in FIG. 4 in the form of a preferred exemplary embodiment. Every printed image or a section 20 of an image is scanned by an image sensor. Before the next copy or section 20 of the image is printed, the printed image is electronically offset by one or more printing nozzles in a direction transverse to the printing direction, causing different nozzles to print the image information. Simultaneously, a mechanical adjustment of the print heads counter to the electronic offset by the same amount and in a direction transverse to the printing direction is implemented, causing the next copy of the printed image to be printed in the same position from the point of view of the image sensor. In terms of the image sensor, the opposite offsets of the digital printed image and of the physical position of the print head cancel each other out. This process changes the assignment of the lines/columns of the image to the nozzles by the amount of the digital offset. In the resultant image, which has been offset twice in opposite directions, a line-shaped artifact that is created by a printing column without printing data, i.e. a desired line is maintained in its original position. In contrast, a line-shaped artifact 13 in the form of a printing column 21 caused by defective nozzles will follow only the physical offset and will thus be offset in the resultant printed image 17. Thus, a simple calculation of the difference between the images scanned by the image sensor with and without digital offset may be used as a reliable detection criterion for a failed nozzle.

A further exemplary embodiment of the calculation of the difference is the integration of the image data recorded by the image sensor over a specific period of time, of a short image section to be defined, to create a brightness profile. This process causes a defect in the printed image to be immediately recognizable: if the nozzles work properly, the brightness profile of the image data, potentially subdivided into individual channels, will match the brightness profile of the previous image section 20. If distinctive maximum and minimum turning points in the added-up brightness profile are offset in synchronism with the offsetting of the printed image 16 relative to the nozzles, a defect 13 caused by a defective or failed nozzle has occurred.

It is likewise possible to implement the digital offsetting of the printed image without any mechanical counter-correction. In this context, the printed image is offset by one or more printing nozzles in a direction transverse to the printing direction, causing different nozzles to print the image information. However, no simultaneous mechanical counter-offset is implemented. In order to allow a correct comparison 18, the image recorded by the camera is offset by the required amount in the respective required direction. Alternatively, the control unit may offset the scanned image 16 by the corresponding amount during the evaluation of the image, i.e. prior to the calculation of the difference. After this operation has been completed, the calculation of the difference of the successive images is possible in the same way. However, a disadvantage is that the absolute position on the substrate changes. For most print jobs, such a minimum absolute offset is tolerable. It does not have any influence on the analysis and the calculation of the difference anyway.

A further exemplary embodiment is a digital offset without mechanical counter-correction in a number of small steps: in this context, the total offset width is unknown or irrelevant as long as the printed image is not moved out of the range of the available printing nozzles. The image analysis in the control unit recognizes the "optical flow" of the moving pixels and is able to differentiate between this and the stationary lines 13 that are created by failed nozzles. In this case, a disadvantage is that an "optical flow" is only created by multiple offsetting processes made in small steps and thus requires a number of prints. In addition, a disadvantage is that this process likewise offsets the absolute position on the substrate.

Figure 5:
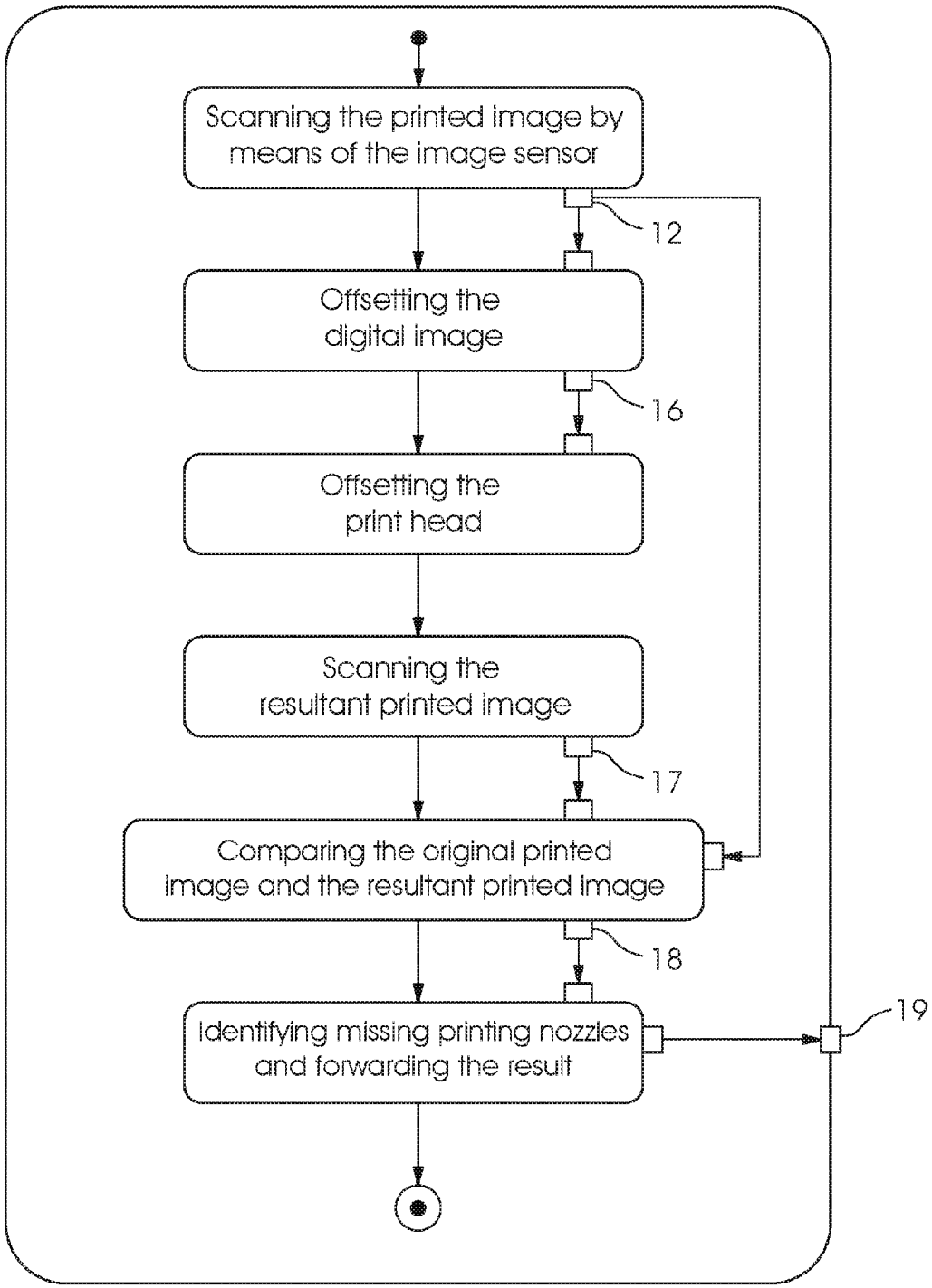
FIG. 5 is a flow chart of the method of the invention.

The method described above is illustrated in a flow chart shown in FIG. 5. In a first step, a first printed image 12 produced according to print image data is scanned by an image scanner. The first printed image 12 is then digitally offset in the control unit 15 by at least one printing nozzle in a direction transverse to the printing direction. Further print processing produces a second printed image 16 on the basis of the digitally offset first printed image 12. The second printed image 16 is scanned and digitized by using the at least one image sensor. The first and second scanned printed images 12, 16 are then compared in the control unit 15. Finally, failed printing nozzles are identified by using the control unit 15 based on a result 18 of the comparison and a result 19 of a detection is output to an operator on a display by the control unit 15. The detection result 19 is used as a trigger for starting a compensation mode of the inkjet printing machine 1 to compensate for the at least one failed printing nozzle.

The invention claimed is:

1. A method for automated detection of failed printing nozzles in an inkjet printing machine, the method comprising the following steps:

carrying out a printing process to produce a first printed image based on print image data;

scanning and digitizing the first printed image produced in the printing process by using at least one image sensor;

digitally offsetting the first printed image in a control unit by at least one printing nozzle in a direction transverse to a printing direction;

carrying out a further printing process to produce a second printed image based on the digitally offset first printed image;

scanning and digitizing the second printed image by using the at least one image sensor;

comparing the first and second scanned printed images in the control unit; and identifying failed printing nozzles by using the control unit based on a result of the comparison.

2. The method according to claim 1, which further comprises in addition to offsetting the first digital printed image by at least one printing nozzle in a direction transverse to the printing direction, offsetting a print head by an equal amount in an opposite direction.

3. The method according to claim 1, which further comprises carrying out the comparison between the first and second scanned digital printed images by calculating a difference.

4. The method according to claim 1, which further comprises outputting a detection result to an operator on a display by the control unit.

5. The method according to claim 4, which further comprises using the detection result as a trigger for starting a compensation mode of the inkjet printing machine to compensate for the at least one failed printing nozzle.

6. The method according to claim 1, wherein the at least one image sensor only scans a respective image section of a respective printed image.

7. The method according to claim 6, which further comprises adding the scanned image sections during an ongoing printing process to create a brightness profile, and calculating a difference between brightness profiles of the scanned image sections of the respective first and second digital printed images.

8. The method according to claim 1, which further comprises offsetting the first digital printed image by at least two printing nozzles in the direction transverse to the printing direction in steps of at least one printing nozzle.

9. An inkjet printing machine, comprising:

a control unit for automated detection of failed printing nozzles in the inkjet printing machine by performing the following steps:

carrying out a printing process to produce a first printed image based on print image data;

scanning and digitizing the first printed image produced in the printing process by using at least one image sensor;

digitally offsetting the first printed image in a control unit by at least one printing nozzle in a direction transverse to a printing direction;

carrying out a further printing process to produce a second printed image based on the digitally offset first printed image;

scanning and digitizing the second printed image by using the at least one image sensor;

comparing the first and second scanned printed images in the control unit; and identifying failed printing nozzles by using the control unit based on a result of the comparison.

* * * * *